US009155437B2

(12) United States Patent
Williams et al.

(10) Patent No.: US 9,155,437 B2
(45) Date of Patent: Oct. 13, 2015

(54) SUCTION CLEANER

(75) Inventors: Thomas Williams, West Midlands (GB); Richard David Waters, Birmingham (GB)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 14/006,453

(22) PCT Filed: Mar. 22, 2012

(86) PCT No.: PCT/GB2012/050638

§ 371 (c)(1), (2), (4) Date: Sep. 20, 2013

(87) PCT Pub. No.: WO2012/127242

PCT Pub. Date: Sep. 27, 2012

(65) Prior Publication Data

US 2014/0007369 A1 Jan. 9, 2014

(30) Foreign Application Priority Data

Mar. 23, 2011 (GB) ..... 1104891.5

(51) Int. Cl.
*A47L 9/16* (2006.01)
*A47L 7/00* (2006.01)
(Continued)

(52) U.S. Cl.
CPC ..... *A47L 9/1683* (2013.01); *A47L 7/0023* (2013.01); *A47L 7/0028* (2013.01); *A47L 9/165* (2013.01); *A47L 9/1675* (2013.01); *A47L 9/18* (2013.01); *A47L 9/183* (2013.01); *A47L 9/242* (2013.01); *A47L 11/34* (2013.01); *A47L 11/4019* (2013.01);
(Continued)

(58) Field of Classification Search
CPC ..... A47L 9/1683; A47L 9/18; A47L 11/34; A47L 11/4019; A47L 11/4094; A47L 9/183; A47L 7/0023; A47L 9/1675; A47L 11/4083; A47L 9/242; A47L 9/165; A47L 7/0028; A47L 11/4088
USPC ..... 15/320–322
IPC ..... A47L 9/16
See application file for complete search history.

(56) References Cited

U.S. PATENT DOCUMENTS 3,774,260 A * 11/1973 Emus, Jr. ..... 15/321
5,815,881 A * 10/1998 Sjogreen ..... 15/321
2007/0209340 A1 9/2007 Conrad

FOREIGN PATENT DOCUMENTS

EP 0768058 A2 4/1997
(Continued)

OTHER PUBLICATIONS

International Search Report for Application No. PCT/GB2012/050638 dated Sep. 26, 2012 (8 pages).

*Primary Examiner* — David Redding
(74) *Attorney, Agent, or Firm* — Michael Best & Friedrich LLP

(57) ABSTRACT

A suction cleaner comprising a source of suction, for creating a suction airflow and a separator upstream of the source of suction, for separating and retaining entrained matter from the suction airflow, wherein the separator is adapted for separation of wet material from the suction airflow, the cleaner has a reservoir for liquid and there is a liquid delivery device for delivering the liquid into the suction airflow which enters the separator.

22 Claims, 9 Drawing Sheets

(51) Int. Cl.

| | |
|---|---|
| ***A47L 9/18*** | (2006.01) |
| ***A47L 9/24*** | (2006.01) |
| ***A47L 11/34*** | (2006.01) |
| ***A47L 11/40*** | (2006.01) |

(52) U.S. Cl.
CPC ..... *A47L 11/4083* (2013.01); *A47L 11/4088* (2013.01); *A47L 11/4094* (2013.01)

(56) References Cited

FOREIGN PATENT DOCUMENTS

| | | | |
|---|---|---|---|
| GB | 2430354 | A | 3/2007 |
| WO | 9510972 | A1 | 4/1995 |
| WO | 2004086930 | A1 | 10/2004 |

* cited by examiner

SUCTION CLEANER

BACKGROUND

This invention relates to suction cleaners ("vacuum cleaners").

So-called "wet or dry" suction cleaners are known, being capable of sucking up solid matter in the manner of conventional suction cleaners, and, when required, liquids such as spillages of water or other liquids. Such cleaners generally incorporate a dust receptacle in the form of a tank. The suction airflow containing the solid or liquid matter which has been sucked up is led into the tank in such a way that any liquid in such air flow is deposited in the tank before the airflow reaches the cleaner's source of suction. If solid matter is to be sucked up, either a dust-filtering and retaining bag is disposed in the tank with the airflow passing through it, or, alternatively, a filter is provided at the exit from the tank leading to the source of suction, so that dry matter separated from the suction airstream by the filter is collected in the tank. Whilst such machines are effective, they may require some adaptation of the cleaner to be carried out by the user depending on whether wet or dry matter is to be sucked up, which is inconvenient. When used in "wet" mode, such a cleaner is also usable for carpet or other surface cleaning, being provided in this case with a tank for cleaning liquid e.g. a solution of a suitable detergent-type substance in water, which is delivered to a cleaning head which also provides for the suction extraction of dirty such liquid from the surface being cleaned.

Another disadvantage of such cleaners when used in the "dry" mode is that accumulation of separated dust in the material of a bag or on a filter can lead to a rapid loss of the suction power of the cleaner.

It is broadly the object of the present invention to address such problems associated with known wet or dry suction cleaners.

SUMMARY

According to one aspect of the present invention, we provide a suction cleaner comprising:

a source of suction, for creating a suction airflow; and a, preferably cyclonic, separator upstream of the source of suction, for separating and retaining entrained matter from the suction airflow;

wherein the separator is adapted for separation of wet material from the suction airflow;

the cleaner has a reservoir for liquid; and there is a liquid delivery device for delivering the liquid into the suction airflow which enters the separator.

Preferably the cleaner has a duct for conveying the suction airflow from a suction inlet to the separator; and the liquid delivery device delivers liquid into airflow in the duct.

In a suction cleaner according to the invention, the use of a cyclonic separator able to separate and retain wet matter from the suction airflow means that the cleaner is usable for wet cleaning tasks such as collection of spilled liquid, in the manner of a conventional "wet" vacuum cleaner or a wet or dry cleaner used in the "wet" mode. On the other hand, when the cleaner is used for conventional sucking up of dry materials, the introduction of the liquid into the suction airflow means that fine particles of dry dust are attracted to water particles, and more readily and effectively separated from the suction airflow by the cyclonic separator.

The liquid delivery device may deliver the liquid into the suction airflow in the form of dispersed fine droplets, which by its nature may include vapour.

Preferably the liquid is or includes water.

The use of a separator capable of separating wet material from the suction airflow also enables the cleaner to be used, if required, as a carpet or other surface cleaner. In this case, liquid from the reservoir thereof may be deliverable to a carpet cleaning tool or head, for application to the carpet, with the liquid subsequently being extracted from the carpet by suction and carried in the suction airflow back to the cleaner for separation from the suction airflow by the separator.

Liquid may be supplied from the reservoir to be delivered into the suction airflow in the duct, or, as required, delivered to a surface-cleaning head or tool, by a pump. Alternatively it may be withdrawn from the reservoir to be delivered into the suction airflow by virtue of the suction airflow in the duct being at a pressure lower than ambient atmospheric pressure. For delivery of liquid to a carpet-cleaning head (or a cleaning head for other surfaces in which cleaning is effected by delivery of liquid thereto and subsequent removal of the liquid by suction) preferably a pump is provided.

For selective delivery of liquid to the suction airflow in the duct or to a surface-cleaning tool, as required, a changeover valve device may be provided. Such a valve device may be operated, to cause liquid delivery to a cleaning head, upon connection to an attachment formation on the valve device of a flexible pipe leading to the cleaning head. When such a flexible pipe is not connected to the valve device, the liquid may be delivered into the suction airflow in the duct.

Preferably, the valve device may be provided adjacent the suction inlet of the cleaner, to which a flexible hose assembly, possibly, with a rigid suction tube portion or wand may be connected.

The liquid reservoir may be demountable from the cleaner for filling, and if the cleaner is to be used without any liquid delivery either into the suction airstream duct or to a cleaning head. When the cleaner is to be used for carpet or other surface cleaning with liquid delivery to and extraction from the surface, a suitable detergent additive, mixed with water, may be used in the liquid reservoir.

The separator, to enable it to be emptied of accumulated liquid and dust, preferably is removable from the cleaner. When fitted to the cleaner, an outlet of the suction airflow duct may register with an inlet to the separator for delivery of the suction airstream to the separator. An outlet from the separator leads to the source of suction airflow in the cleaner.

When fitted to the cleaner, the separator may lie with its axis (about which cyclonic airflow takes place in the separator) at an inclination to the vertical and to the horizontal (assuming the cleaner is supported on a generally horizontal surface).

Preferably the separator has an internal passageway, extending from the inlet thereof to a point higher, when the cleaner is in use, in the separator than is the inlet. Thus, the liquid capacity of the separator may be maximised even if the inlet thereto is not adjacent the top of the interior of the separator.

The separator, which as above mentioned is of the cyclonic type, may have a first receiving portion in which the suction airflow, as it leaves the internal passage of the separator, rotates within the separator in cyclonic manner, causing a first stage of separation of material from the suction airflow. The suction airflow may thence flow inwardly through a grille formation comprising a plurality of circumferentially spaced vanes extending lengthwise of an upright axis of the separator, causing the airflow speed to be decreased so that any remaining liquid or solid matter therein is deposited in the separator. The suction airflow leaves the settling chamber after having deposited virtually all liquid and or solid matter entrained therein, to flow to the source of such airflow in the cleaner.

The configuration of the separator will be described in greater detail hereafter. According to a second aspect of the invention, we provide a suction cleaner comprising a source of suction, for creating a suction airflow, a separator upstream of the source of suction, for separating and retaining entrained matter from the suction airflow, a reservoir for liquid and a liquid delivery device operable selectively to deliver the liquid either into the suction airflow upstream of the separator or to a surface-cleaning head or tool connected to the cleaner.

According to a third aspect of the invention, we provide a suction cleaner comprising a source of suction, for creating a suction airflow, a separator for separating and retaining entrained wet material from the suction airflow, the separator having an inlet for the suction airflow and an outlet for connection to the source of suction, wherein the separator has an internal passageway, extending from the inlet of the separator to a point higher in the separator than is the inlet, in use.

A cleaner in accordance with the second or third aspect of the invention may include any of the features of the first aspect of the invention as above set forth, as required.

BRIEF DESCRIPTION OF THE DRAWINGS

Further features of the invention, in addition to those mentioned above, will now be described by way of example with reference to the accompanying drawings, of which

DETAILED DESCRIPTION

Figure 1:
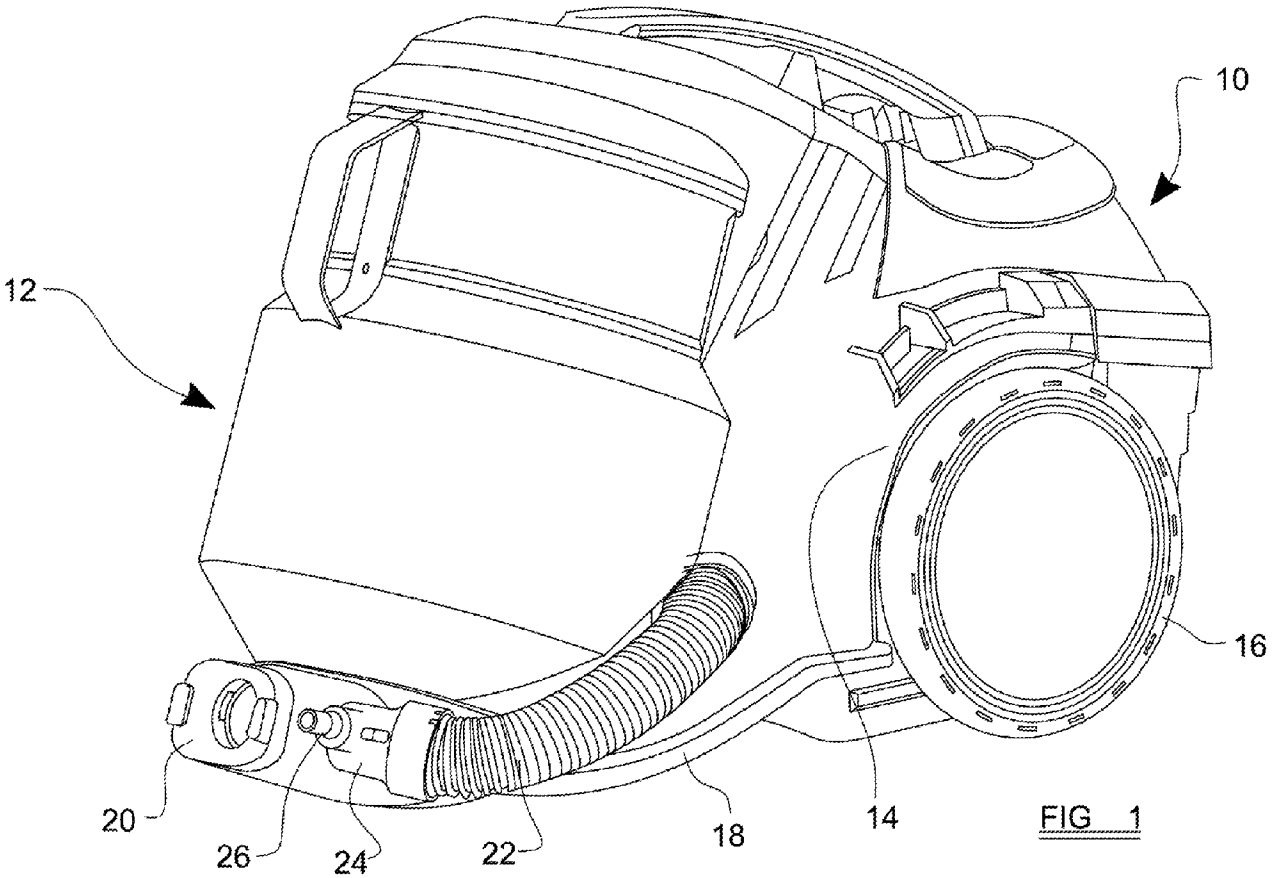
FIG. 1 is a perspective view of the exterior of an embodiment of vacuum cleaner in according with the invention, from the front and one side.
Figure 3A:
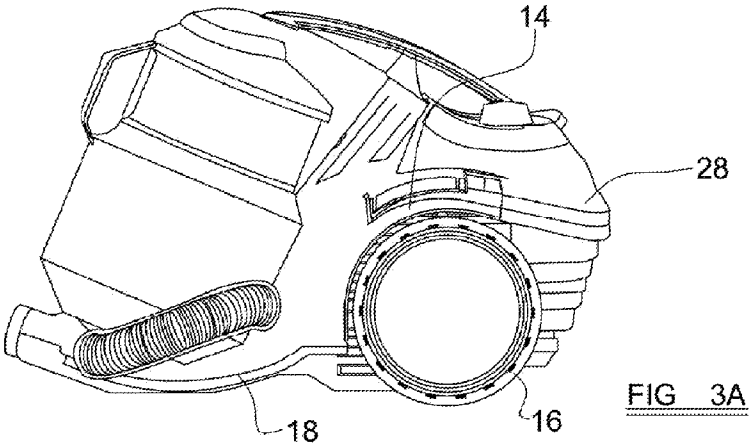
FIGS. 3*a* and 3*b* are side views of the cleaner, illustrating features thereof.
Figure 3B:
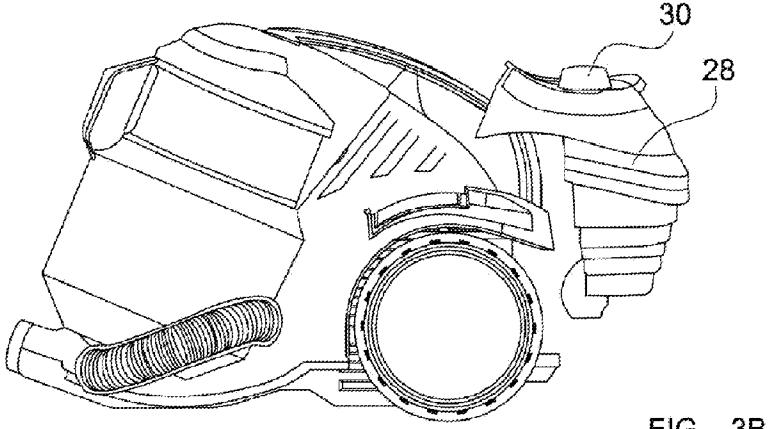
Figure 2:
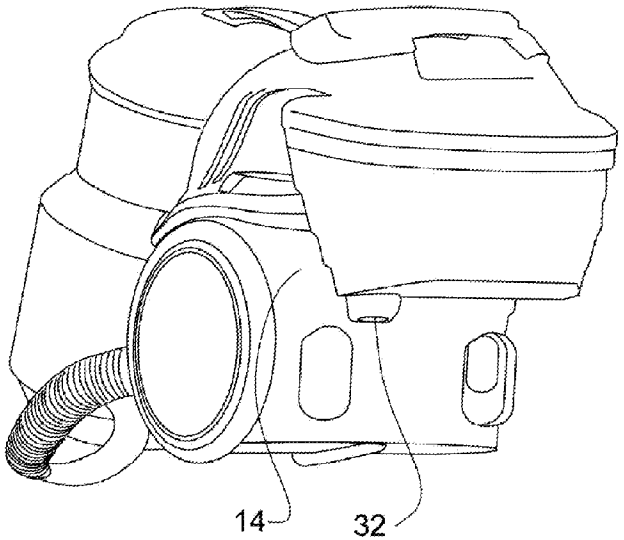
FIG. 2 is a perspective view of the vacuum cleaner, from the side and rear.
Figure 4:
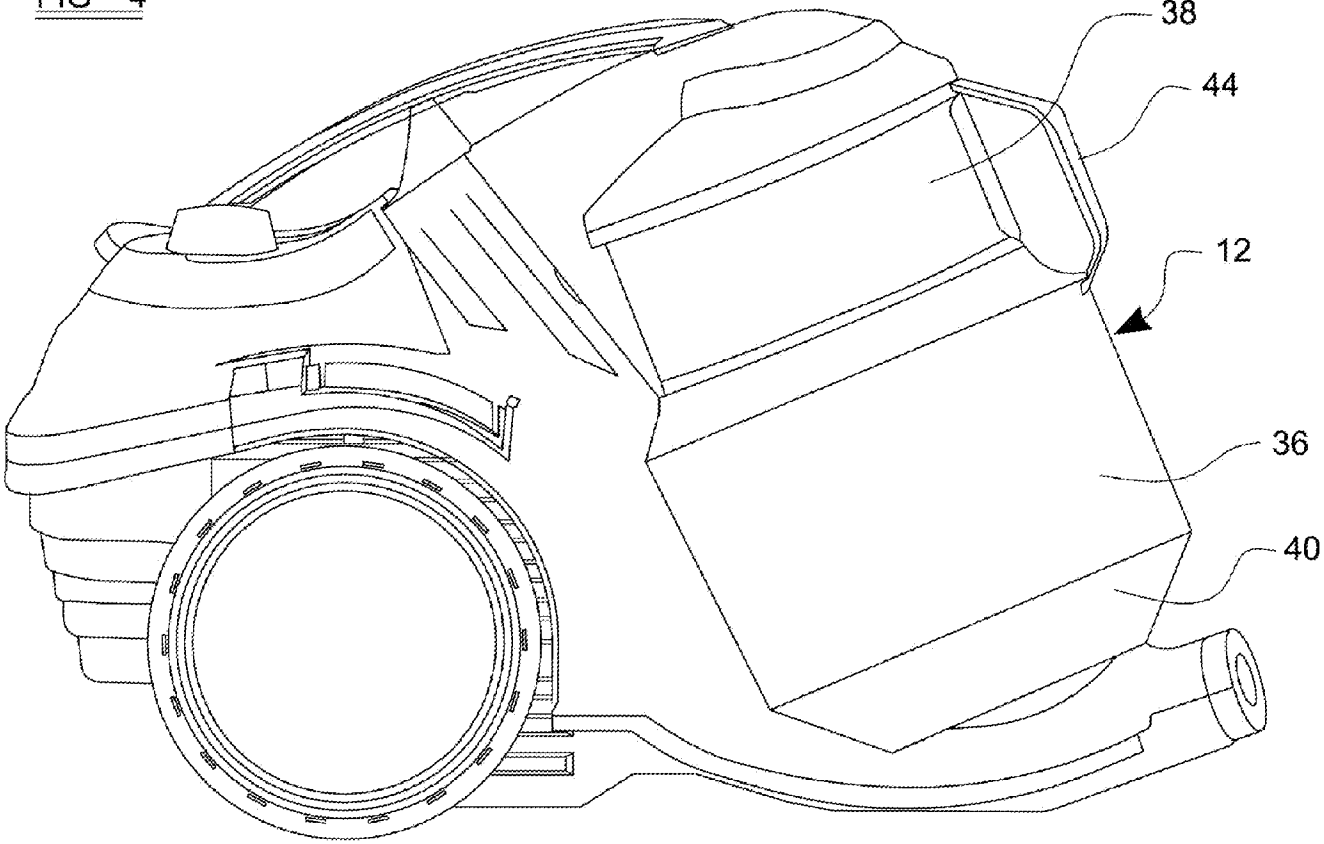
FIG. 4 is a view of the cleaner from the opposite side.

Referring firstly to FIGS. 1, 2 and 3 of the drawings, there is illustrated a cleaner 10 whose principal components include a body indicated generally at 10 and a separator indicated generally at 12, the separator being removably attached to the body 10. The body 10 houses, in a manner generally known in cleaners, a source of suction for creating a suction airflow, the source of suction comprising an electric motor and a suitable fan or impellor driven thereby. Because, as will be appreciated by a person skilled in the art, it is not impossible that the suction airflow reaching the suction source may contain liquid, the electric motor is of the so-called by-pass type, in which the suction airflow does not pass through the motor for cooling same but rather a separate airflow is caused to pass through the motor for cooling purposes.

The suction source of the cleaner is disposed in a rear body part 14, generally in a region between rear wheels 16. From the body part 14, a chassis part 18 extends forwardly beneath the separator 12, and supports the latter which is held to the body part 14 by a suitable latch or clip arrangement. At the front end of the chassis 18, there is a suction inlet formation 20 for connection of a flexible hose, whose remote end can be connected to a cleaning head or tool of any required type, possibly through the intermediary of a tubular wand which may comprise two or more telescopically-connected sections. The cleaner may be used with a surface cleaning head or tool, e.g. intended for carpet and/or upholstery cleaning, of the known kind in which a cleaning solution (typically a suitable detergent added to water) is applied to whatever is being cleaned and subsequently extracted therefrom by suction at the cleaning head, from which it is drawn back in the dirty condition to be stored in the cleaner.

From the hose connector 20, the suction airflow is led back to the machine through a duct including a part 22 which is formed of a flexible hose material, the duct leading to an inlet to the separator described hereafter. The duct hose 22 connects to the hose connector 20 through a connection elbow 24, having a liquid delivery device and changeover valve assembly indicated generally at 26, also described in greater detail hereafter.

The suction cleaner may be provided with a storage compartment including a storage reel and rewind mechanism for a mains electrical power cable. All other operative features typically provided in suction cleaners, as well known to persons skilled in the art, may be provided. At the rear of the cleaner, a reservoir 28 for liquid, normally water with any required additives such as a detergent if the cleaner is going to be for carpet or other surface cleaning, a bactericidal agent, etc., is detachably fitted. The reservoir has a filler cap 30 and an outlet 32, through which the liquid may be delivered to the delivery and valve assembly 26 by means of an electrically-powered pump operable when the suction source of the cleaner is operating, through a suitable pipe arrangement, not shown. The reservoir 28 is shown attached to the cleaner in FIG. 3*a*, and detached in FIG. 3*b*.

Figure 5:
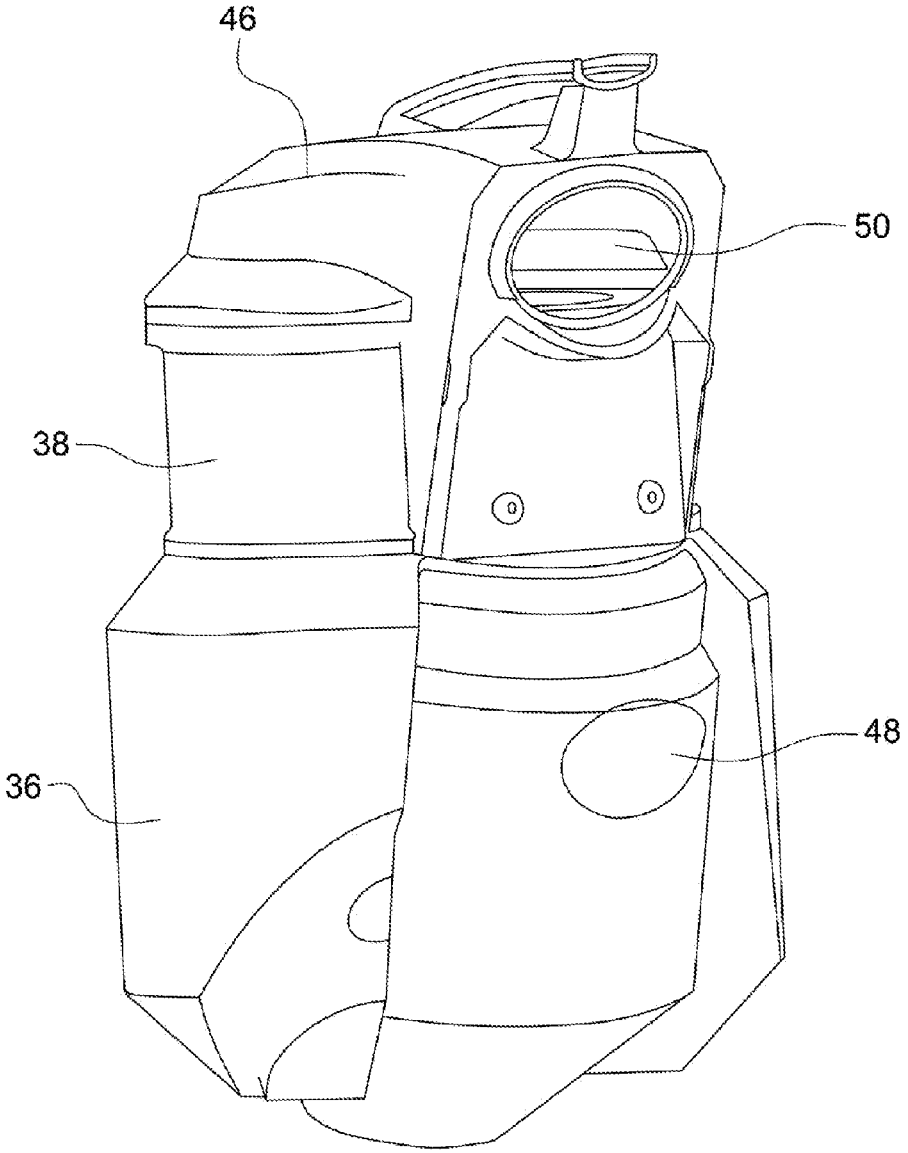
FIG. 5 is a perspective view of a separator of the cleaner.

Referring now to FIGS. 4 to 8 of the drawings, the separator 12 and its relationship with the rest of the cleaner will now be described in greater detail. The separator has an outer container whose visible part, when the separator is in-situ in the cleaner, comprises a part-cylindrical lower outer wall portion 36 and upper outer wall portion 38 of smaller diameter of the lower portion 36. At its lowermost end, the wall portion 36 is closed by a frusto-conically tapering portion 40 then a recessed base 42 which interfits with a projection on the chassis part 18 beneath the separator. A handle 44 extends between the top of the wall portion 36 and the top of the wall portion 38, so that the outer container of the separator is generally in the form of a "jug". A cover structure 46 is connected to the top of the container part of the separator. The part of the separator which faces and fits closely to the body 14 of the cleaner is shaped as shown in FIG. 5, and the rearmost continuation of the wall portion 36 has an inlet aperture 48 by which the suction airflow of the cleaner can enter the separator. When the separator is in situ, the aperture co-operates with the end of the duct hose 22 which is held in the body of the cleaner, with a suitable seal being interposed to prevent leakage where the airflow enters the separator. The cover part 46 of the separator has an outlet aperture 50 for suction airflow, co-operating with a duct in the body of the cleaner which leads to suction source, i.e. the motor-driven fan, of the cleaner. A suitable filter may be provided in the cover 46, to provide filtration of the suction airflow leaving the separator.

Figure 6B:
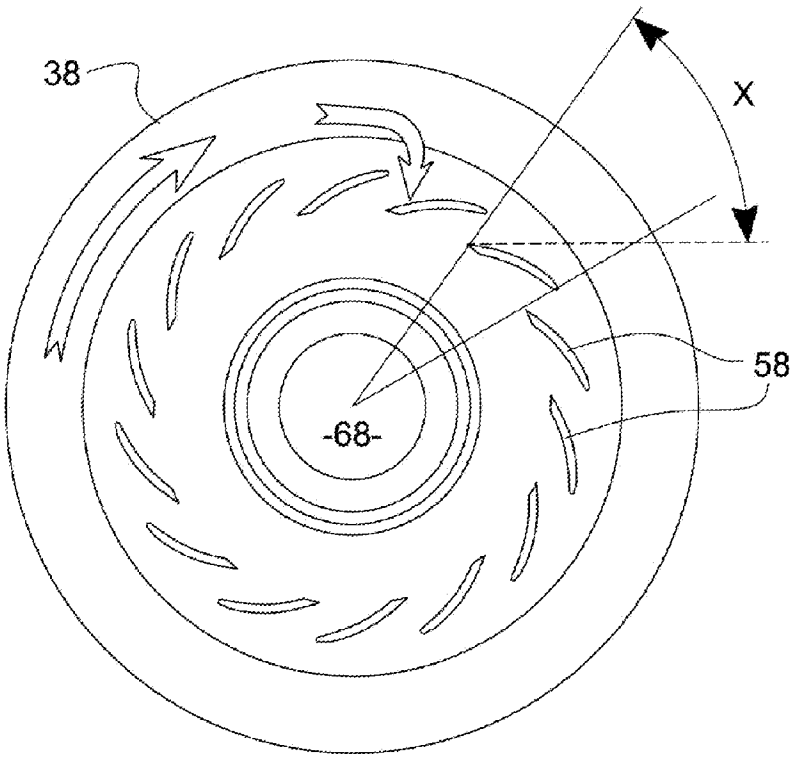
FIGS. 6*a* and 6*b* are a side view and section through part of the separator.
Figure 6A:
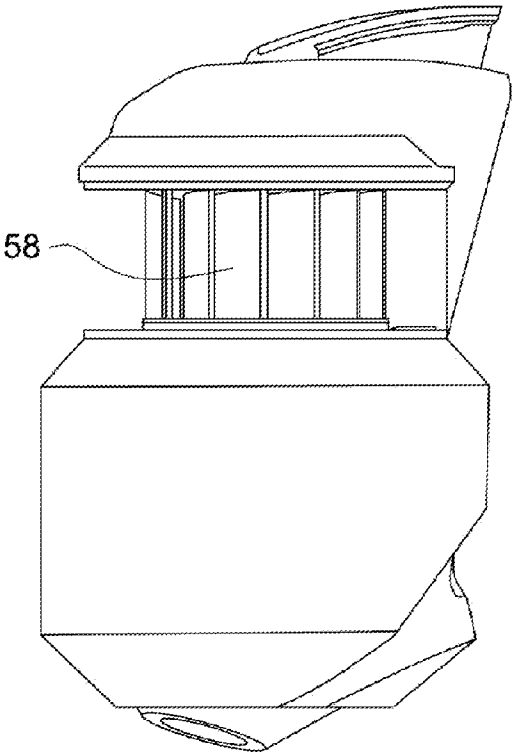
Figure 7B:
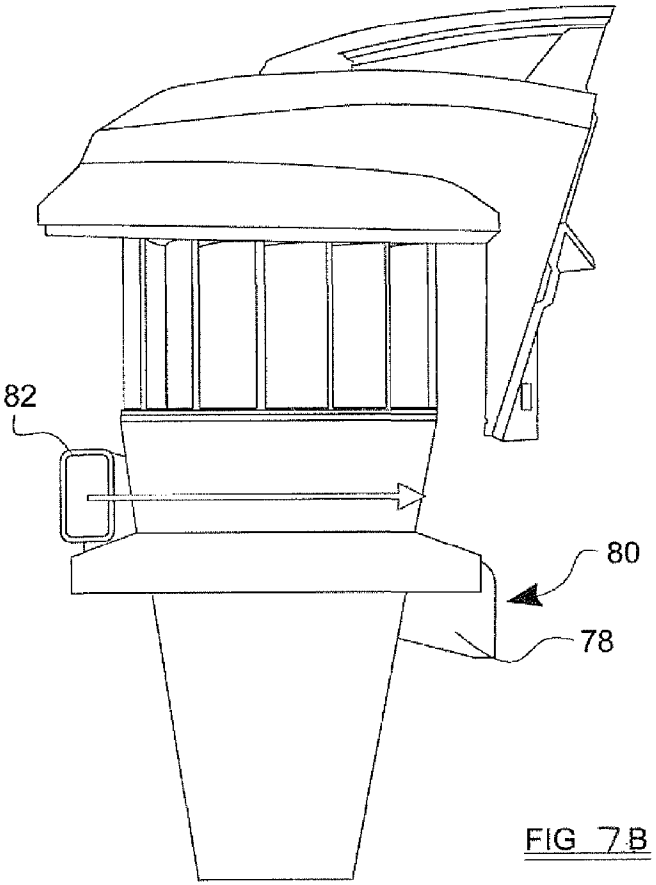
FIGS. 7*a* and 7*b* are views of the separator from opposite sides, showing internal detail thereof.
Figure 7A:
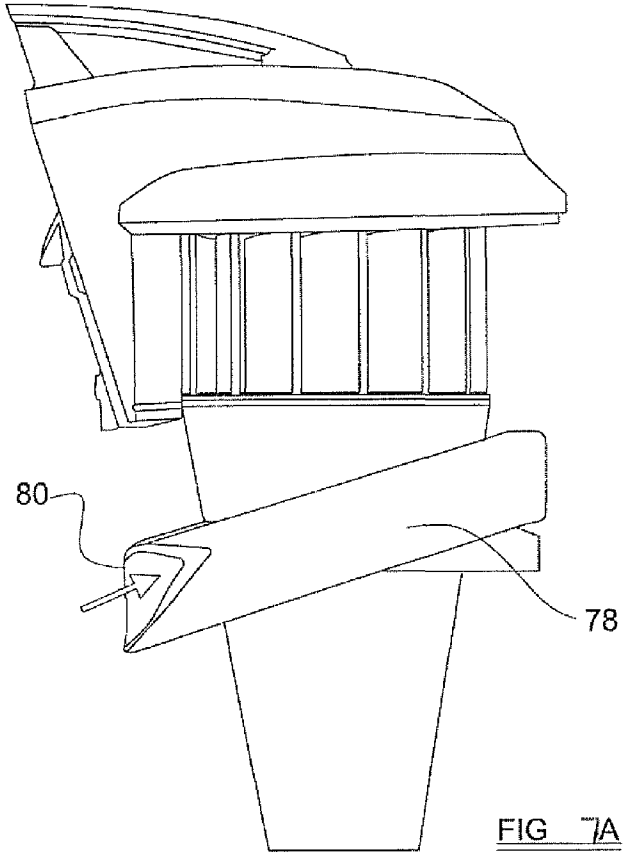
Figure 8:
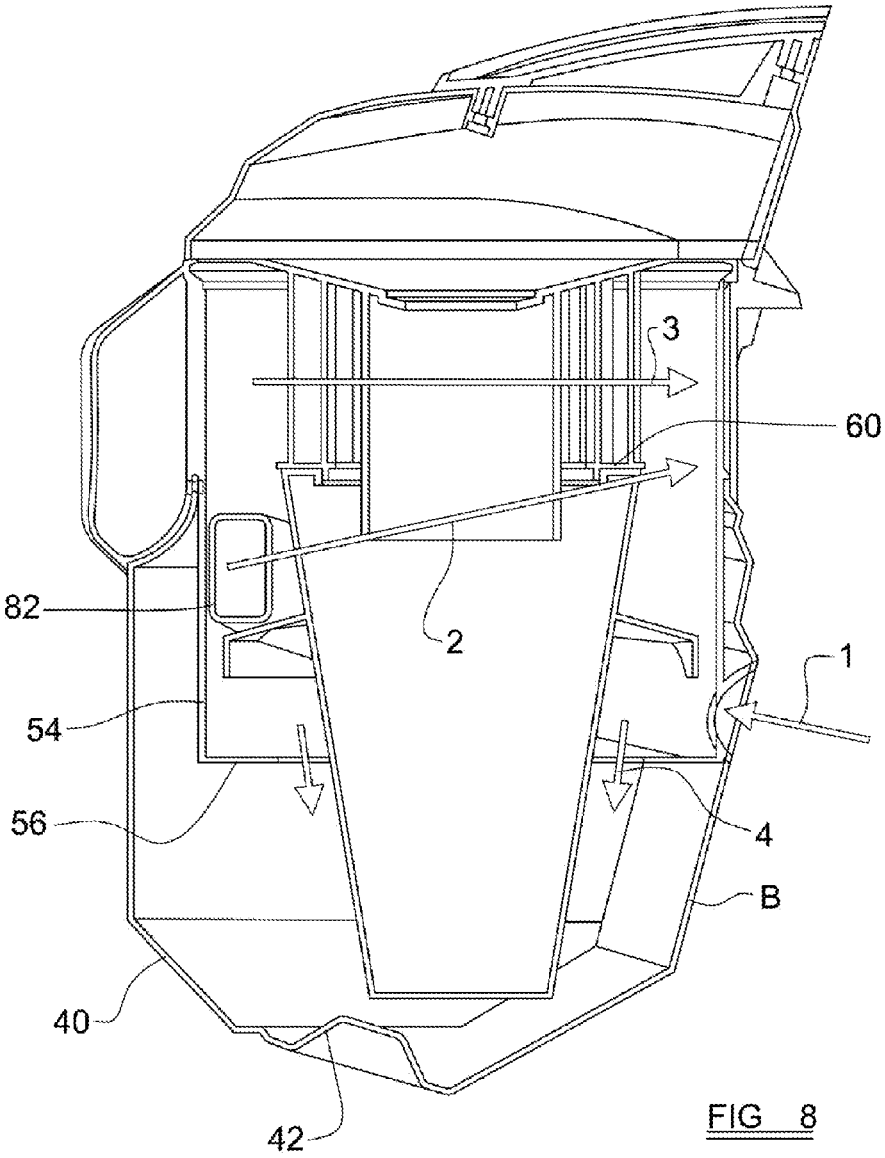
FIGS. 8 and 9 are sections through the separator, illustrating the airflow in different parts thereof.
Figure 9:
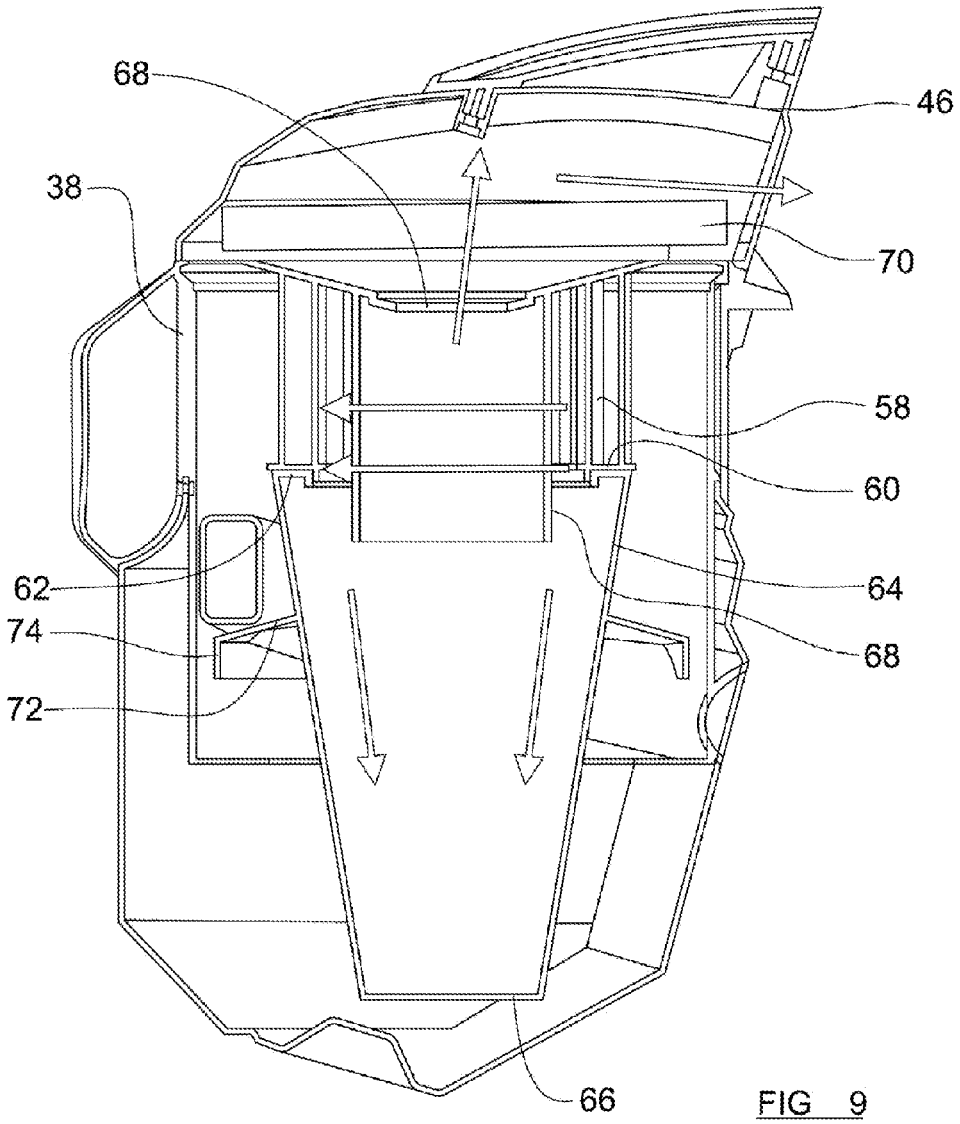

Inside the outer container of the separator, a cylindrical wall 54 extends downwardly within the container in continuation of the exterior wall part 38, and at the lowermost end of the wall 54 there is an annular radially inwardly-extending wall portion 56. Within the wall 54, a structure including a grille having a plurality of circumferentially-spaced vanes 58 extends downwardly from the cover 46, the lowermost ends of the vanes being joined in an annular seating 60. This configuration of the vanes is seen most clearly in FIGS. 6 and 7, FIG. 6*b* showing the vanes 58 in section, looking upwardly from beneath Beneath the grille assembly, the annular seating 60 is abutted by an inwardly extending flange 62 at the top of a tapering cup 64 having a closed lower end 66. Centrally within the grille, an airflow outlet pipe 68 extends upwardly from a position a short distance down the cup 64 from the lip 62 and seating 60, and leads to an aperture 68 into the interior of the cover 46. The above-mentioned filter within the cover 46 may be disposed where indicated at 70 in FIG. 9.

The cup 64 has, on its exterior surface, a "skirt" formation 72, which extends radially outwardly and slightly downwardly, in frusto-conical configuration, from the cup and has, at its outermost edge, a short downwardly extending cylindrical wall. Beneath the skirt, there is a clearance between the cup exterior and the inner edge of the wall portion 56. An airflow transfer duct most clearly seen in FIGS. 7*a* and 7*b* and indicated at 78, extends helically within the separator. The transfer duct 78 has an entrance 80 which registers with the aperture 48 in the outer container of the separator, and an exit 82 which is nearly diametrically opposite the entrance 80 and farther from the base of separator than is the entrance 80. Thus the exit 82 of the duct 78 is, bearing in mind the inclined orientation of the separator, at a much higher level than its entrance 80, so that the separator is able to hold a much greater quantity of liquid than would be the case if the transfer duct 78 were not present. The exit 82 faces circumferentially of the cylindrical wall 54.

The path of the suction airflow within the separator is as follows. Entering the separator from the duct 22 by way of the aperture 48 and transfer duct 78 as indicated by arrows 1 and 2 in FIG. 8, air rotates within the cylindrical wall 38 and 54 (arrow 3) providing a first cyclonic separating stage. Matter including large-particle dust and liquid droplets separated thereby moves downwardly within the wall 54, past the skirt 74 to fall into the base of the outer container of the separator, through the annular space between the annular wall 56 and the exterior of the cup 74 as indicated by arrows 4. In the uppermost part of the separator, the airflow with any remaining entrained matter therein passes inwardly through the vanes 58 into a settling chamber within the cup 74 to provide a second stage of separation, the matter separated remaining within the cup 74. Thence, the flow of air is upwardly into the open lowermost end of the pipe 68, and out of the separator by way of the aperture 68, filter 70, and aperture 50.

FIG. 6*b* of the drawings, shows, in the underneath view, looking upwardly, of the vanes 58, the direction of rotation of airflow within the wall 38 and to the exterior of the vanes 58, indicated by arrow 58*a*. This also illustrates that the circumferential extent of the vanes 58 is such that they do not overlap one another in the direction circumferentially of the assembly. The outermost edge of each vane may be spaced by a distance of the order of 40 mm to 80 mm from the interior of the wall portion 38, while the radially-innermost edge of each vane may be inclined to the tangent to the central axis of the separator assembly at an angle X of approximately 55° to 65°. Each vane itself may have a cross-sectional shape which is arcuate, being part of a circle of diameter approximately 95 mm to 115 mm.

For airflow to pass inwardly through the spaces defined between the vanes 58, the airflow has to change direction by 90° or slightly more. This is effective at causing separation of liquid particles from the air flow.

The separator preferably is provided with a detector device for detecting the amount of liquid matter separated from the suction airflow and retained in the separator, and arranged to cause operation of the cleaner to be discontinued when a safe maximum fill level of separated matter has been reached. Such a detector may operate by use of a float, or otherwise e.g. a solid-state device. Since most matter is separated by the first separation stage, the device may respond to the level in the main outer container of the separator, although it or another device may detect the level in the cup 64. A switch may be operated to cause the motor of the cleaner to cut out, or the airflow may be changed so that no more can be sucked in even though the motor continues to operate.

By way of example, a float disposed in a part of the separator which is distant from the body of the cleaner when the separator is fitted to the cleaner may be connected by a pivoted lever arrangement to a magnet element which is positioned in the separator to be adjacent the cleaner's rear body part 14. The lever arrangement may provide for an upwards and downwards movement of the magnet element greater than that of the float. A magnetically-operable switch, e.g. a reed switch, in the body part 14 may operate to prevent the motor of the cleaner from functioning when the level of liquid in the separator, as detected by the float, reaches or exceeds a predetermined safe maximum level.

The above-described configuration of separator, within its two separating stages and grille arrangement therebetween, provides effective separation of liquid as well as solid matter from the suction airflow. Hence, the cleaner is usable for conventional dry vacuum cleaning, or for wet cleaning operations such as spill collection or carpet or other surface washing. When used for dry vacuum cleaning, separation of dry dust and other matter entrained in the suction airflow can be enhanced by introducing water into the suction airflow entering the separator, and it is for this purpose that the change over/liquid delivery valve assembly 26 is provided. The valve assembly is shown in greater detail in FIGS. 10*a* and 10*b*.

Figure 10B:
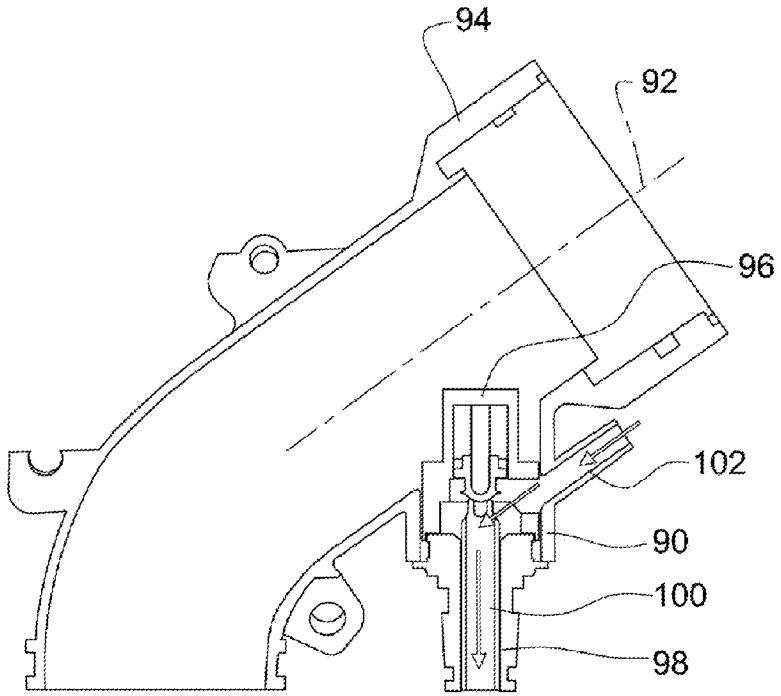
FIGS. 10*a* and 10*b* are partly sectioned detailed views showing a change-over valve of the cleaner, in different operative positions.
Figure 10A:
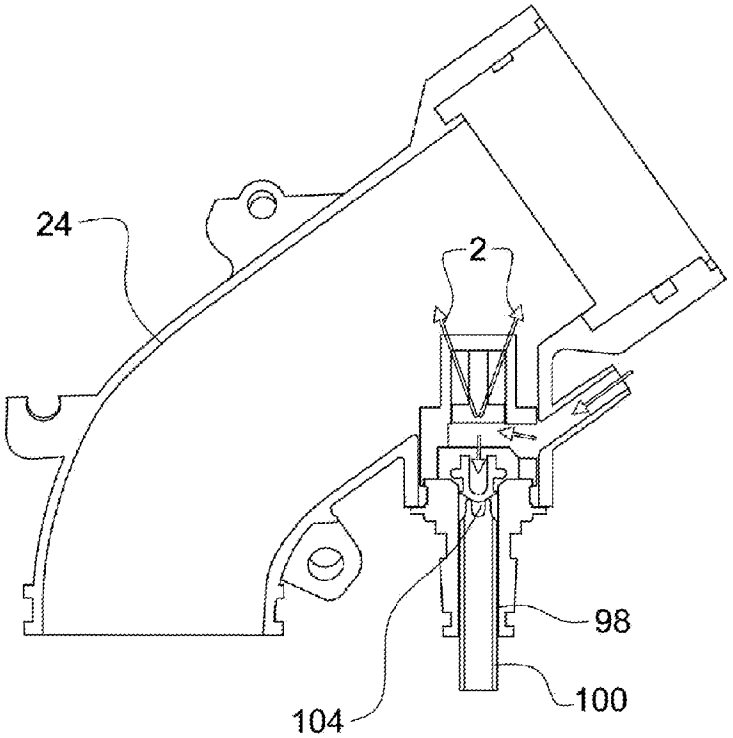

The valve assembly 26 is fitted in the wall of the connection elbow 24 by which the duct hose 22 is connected to the hose connection 20. FIGS. 10*a* and 10*b* show that the elbow 24 has a tubular side portion 90 which is inclined to the central axis 92 of the elbow, providing a passage which faces a collar part 94 of the elbow by which the duct hose 22 is connected thereto. In the passage defined by the portion 90, there is received a valve body which is in two parts of which a first part 96 extends into the suction airflow passage afforded by the elbow, towards the axis 92. A second part 98 of the valve body extends outwardly from the passage within the portion 90, and is in the form of a spigot adapted for connection of a push-on connector leading, by way of a flexible tube, to a carpet or other surface cleaning tool or head. Within the part 98, a valve member 100 is moveable in the direction of its length, and it is biased by a spring, not shown, to the position in which it is shown in FIG. 10*a* and in which extends outwardly of the valve body part 98. A spigot 102 extends outwardly of the part 90 generally parallel to the axis 92, for push-on fitting of a flexible plastics pipe leading from the liquid reservoir 28 by way of the pump. The pump is electrically operated when the suction-creating motor of the vacuum cleaner is running.

When the valve member 100 is in the position shown in FIG. 10*a*, it protrudes outwardly of the valve part 98 and no liquid can flow therethrough. The spigot 102 communicates with the interior of the valve body part 96, and from there the liquid can flow outwardly through a small aperture or apertures in the part 96 to enter the interior of the elbow 24 and duct 22.

When the above-mentioned fitting for conveying liquid to a surface-cleaning head or tool is fitted to the valve body part 98, the valve member 100 is displaced to the position in which it is shown in FIG. 10*b*. In this position, it blocks the path for flow of liquid from the spigot 102 into the interior of the elbow 24 and duct 22, whilst a number of apertures 104 in the valve member are then accessible to the liquid. The liquid therefore flows out through the valve member 100, to be delivered to the cleaning head or tool.

It is contemplated that the vacuum cleaner in accordance with the invention could alternatively be used with a cyclonic separator which is essentially capable of separating only dust and other dry matter from the suction airflow. Indeed, such a separator may be provided as an additional or alternative fitment with the cleaner. To ensure that, when the cleaner is fitted with a separator which will not satisfactorily operate under wet conditions, the cleaner is not used with its liquid-supplying mechanism operational, the separator as above described may be provided with a mechanism or device which co-operates with a complementary feature of the body of the cleaner to ensure that the components associated with the wet cleaning mode operate only when the correct separator is fitted. For example, the separator may be provided with a magnet which operates a reed switch carried by the body of the cleaner, to permit the electrical pump delivering the liquid from the reservoir to operate when the suction-creating motor of the cleaner is running. Alternatively, a mechanical interlock may be provided.

The invention thus provides a cleaner which is highly versatile in terms of its ability to operate in wet or dry modes, whilst providing for effective separation of dust when in the latter mode.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

We claim:

1. A suction cleaner comprising:

a source of suction for creating a suction airflow;

a separator upstream of the source of suction for separating and retaining entrained matter from the suction airflow;

wherein the separator is adapted for separation of wet material from the suction airflow;

a reservoir for a liquid; and a liquid delivery device for delivering the liquid into the suction airflow which enters the separator, wherein the suction cleaner is adapted for operation with an alternative separator for separation of dry material, and further comprising interlock means for preventing operation of the liquid delivery device when operating with the alternative separator.

2. A suction cleaner according to claim 1 wherein the separator is cyclonic.

3. A suction cleaner according to claim 1 wherein the cleaner has a duct for conveying the suction airflow from a suction inlet to the separator, and the liquid delivery device delivers liquid into airflow in the duct.

4. A suction cleaner according to claim 3 wherein the device delivers liquid in the form of dispersed fine droplets.

5. A suction cleaner according to claim 1 wherein the liquid includes water.

6. A suction cleaner according to claim 3 wherein liquid is alternatively deliverable to at least one of a surface-cleaning head or tool.

7. A suction cleaner according to claim 1 further comprising a pump for the liquid delivery.

8. A suction cleaner according to claim 6, further comprising a changeover valve device operable to selectively effect delivery of liquid to at least one of the duct, the surface cleaning head, or the tool.

9. A suction cleaner according to claim 8 wherein the valve device is operable on connection of a pipe to an attachment formation of the valve device.

10. A suction cleaner according to claim 8 wherein the valve device is provided adjacent the suction inlet of the cleaner.

11. A suction cleaner according to claim 1 wherein the liquid reservoir is demountable from the cleaner.

12. A suction cleaner according to claim 1 wherein the separator is removable from the cleaner.

13. A suction cleaner according to claim 12 wherein the separator has an inlet for suction airflow which, when the separator is fitted to the cleaner, registers with an outlet of a suction airflow duct of the cleaner, the separator further having an outlet which leads to the source of suction airflow in the cleaner.

14. A suction cleaner according to claim 13 wherein the separator has an internal passageway, extending from the inlet of the separator to a point higher in the separator than is the inlet, in use.

15. A suction cleaner comprising:

a source of suction for creating a suction airflow;

a separator upstream of the source of suction for separating and retaining entrained matter from the suction airflow, the separator including a cyclonic portion and a settling chamber, through which the suction airflow passes successively, wherein the settling chamber portion of the separator is disposed interiorly of the cyclonic portion;

wherein the separator is adapted for separation of wet material from the suction airflow;

a reservoir for a liquid;

a liquid delivery device for delivering the liquid into the suction airflow which enters the separator; and a grille formation having a plurality of circumferentially spaced vanes, through which the suction airflow passes inwardly from the cyclonic portion to the settling chamber portion.

16. A suction cleaner according to claim 1 further comprising a detector for detecting a level of the liquid within the separator.

17. A suction cleaner according to claim 16 wherein the detector is arranged to discontinue operation of the cleaner when a predetermined level of liquid is reached.

18. A suction cleaner according to claim 16 wherein the detector includes a float.

19. A suction cleaner according to claim 18 wherein the detector operates a switch to prevent operation of the source of suction of the cleaner.

20. A suction cleaner according to claim 19 wherein the switch is operated by a magnetic element moved by the float.

21. A suction cleaner comprising a source of suction for creating a suction airflow;

a separator upstream of the source of suction for separating and retaining entrained matter from the suction airflow;

a reservoir for liquid; and a liquid delivery device operable selectively to deliver the liquid to one and only one of the suction airflow upstream of the separator or to one of a surface-cleaning head or tool connected to the cleaner at any given time.

22. A suction cleaner comprising;

a source of suction for creating a suction airflow;

a separator selectively removable from the air cleaner, the separator, when fitted to the cleaner registers with an outlet of a suction airflow duct of the cleaner, the separator operable for separating and retaining entrained wet material from the suction airflow, the separator having an inlet for the suction airflow and an outlet for connection to the source of suction;

wherein the separator has an internal passageway extending from the inlet of the separator to a point higher in the separator than is the inlet, in use.

* * * * *